United States Patent [19]

Slagel et al.

[11] 4,056,432

[45] * Nov. 1, 1977

[54] PROCESS FOR MAKING PAPER PRODUCTS OF IMPROVED DRY STRENGTH

[75] Inventors: Robert Clayton Slagel, Pittsburgh; Gloria DiMarco Sinkovitz, Bridgeville, both of Pa.

[73] Assignee: Calgon Corporation, Pittsburgh, Pa.

[ * ] Notice: The portion of the term of this patent subsequent to Jan. 9, 1990, has been disclaimed.

[21] Appl. No.: 160,097

[22] Filed: July 6, 1971

[51] Int. Cl.[2] ..... D21D 3/00

[52] U.S. Cl. ..... 162/168 NA; 162/177; 260/17.4 GC

[58] Field of Search ..... 162/168, 175, 177; 260/17.4 GC

[56] References Cited

U.S. PATENT DOCUMENTS

| | | | |
|---|---|---|---|
| 2,216,845 | 10/1940 | Larson | 162/177 |
| 2,748,029 | 5/1956 | Spear et al. | 162/168 |
| 3,095,391 | 6/1963 | Brockway et al. | 260/17.4 GC |
| 3,288,770 | 11/1968 | Butler | 260/47 R |
| 3,445,556 | 5/1969 | Kuzwak et al. | 260/17.4 GC |
| 3,639,208 | 2/1972 | Varveri et al. | 162/168 |
| 3,709,780 | 1/1973 | Slagel et al. | 162/168 |

*Primary Examiner*—S. Leon Bashore
*Assistant Examiner*—Kenneth M. Schor
*Attorney, Agent, or Firm*—Harry E. Westlake, Jr.; Frank M. Mahon; Raymond M. Speer

[57] ABSTRACT

Paper products exhibiting markedly improved dry strength properties are produced by adding to the cellulose paper dispersion a chitin-based compound comprising chitosan alone or a graft copolymer of certain acrylic and/or diallylic monomers grafted onto the chitosan as a substrate.

1 Claim, No Drawings

PROCESS FOR MAKING PAPER PRODUCTS OF IMPROVED DRY STRENGTH

BACKGROUND OF THE INVENTION

The present invention is directed to paper products exhibiting markedly improved dry strength properties. These products are prepared by incorporating into the paper product a chitin-based compound comprising a chitosan or a novel graft copolymer of certain acrylic monomers or diallylic monomers onto a chitosan substrate. These chitin compounds are incorporated into the paper product during the papermaking process, preferably by adding them to the aqueous cellulosic pulp dispersion.

It is a well-accepted fact that it is desirable in many applications to have paper products with good dry strength. In addition, it is well known that the paper industry has a strong movement underway to reduce the basis weight of paper, especially that of publication-grade paper. Reduced basis weight in paper would correspondingly reduce mailing cost. Dry strength aids are needed for lighter weight paper because as the basis weight is lowered, the dry strength of the paper also decreases. By using dry strength additives to maintain the strength of the lower basis weight paper, the production costs are reduced since less pulp and power are needed to make an equivalent sheet.

In the past, natural polymers such as guar and locust bean gums and the native and modified starches have been the most commonly used dry strength additives. The performance of these natural polymers is difficult to control and hence somewhat inconsistent. In addition, the use of starches involves lengthly preparation procedures and they are not well retained by the fibers without the use of additional costly additives. However, because of their low cost and availability, these compounds have heretofore been used despite their disadvantages.

More recently, several synthetic dry strength resins have appeared on the market. These compounds are basically modified polyacrylamides or modified cationic starch derivatives. These compounds, while somewhat effective under normal conditions, do not maintain paper strength at lower basis weight and they do not function well in alkaline media. The requirement of functioning well in an alkaline system is important since there is a desire in the paper industry to change from the present acid (pH 4 to 5.5) system of papermaking to neutral or alkaline (pH 7 to 8.5) system. The acid system is detrimental to machine parts and results in a paper sheet that becomes brittle and yellow with age. Another advantage of an alkaline system is that an inexpensive pigment, such as calcium carbonate, can be used instead of the more expensive titanium dioxides and aluminum oxides.

Therefore, it is an object of this invention to produce a dry strength additive which works well in low basis weight paper, gives consistent performance and performs well in both alkaline and acidic systems.

SUMMARY OF THE INVENTION

We have found that paper products have superior dry strength properties when they contain from 0.1 to 5.0 percent by weight based on the dry weight of the paper of a chitin-based compound. The chitin-based compounds are selected from chitosan and graft copolymers of certain acrylic and diallylic monomers onto a chitosan substrate.

Chitin is a naturally-occurring linear amino polysaccharide found in crustacean shells. It is a long, unbranched polysaccharide-like cellulose in which the hydroxyl group of the $C_2$ carbon has been replaced by an acetylamino group. Chemically, it is a polymer of acetylated d-glucosamine. The structure of chitin is shown below. The basic repeating unit is the two hexose residues and the naturally-occurring chitin contains from about 1,000 to 3,000 basic units.

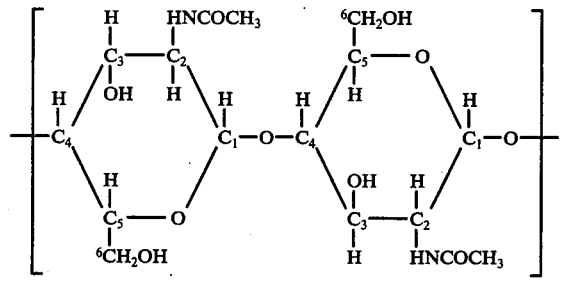

Chitosan is the acid-soluble deacetylated derivative of chitin. It is prepared by reacting chitin with an aqueous hydroxide solution. The formula of chitosan is shown below.

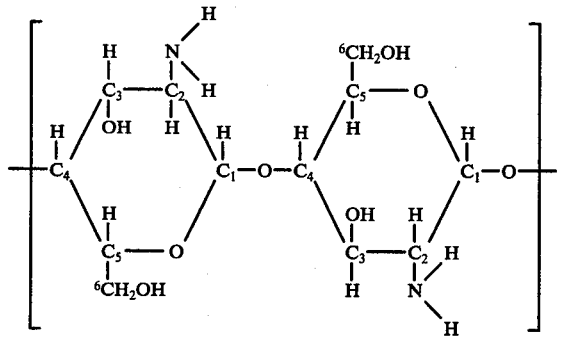

Both chitin and chitosan are well reported in the literature. For example, see the article entitled "Chitin" by A. B. Foster and J. M. Weber in *Advances in Carbohydrate Chemistry,* V. 15 (1960), PP. 371–393 and in the article entitled "Chitin and Its Association with Other Molecules" by K. N. Rudall, *Journal of Polymer Science,* Part C, No. 28, PP. 83–102 (1969). Finally, see the article "Chitosan: A Natural High Polymer Not Well Known in Industry" by Patrick Broussighac, found in Chemie et Industrie, Genie Chem., V. 99, No. 9, PP. 1241–1247 (1968). In addition, see U.S. Pat. No. 3,533,940, which is directed to chitin and chitosan and their use in treating water to remove impurities.

The chitosan useful in our invention is prepared by reacting chitin with concentrated alkali at high temperatures. The reaction may be run as a fusion reaction or as a solution so long as the resulting product is at least a partially deacetylated product of sufficient solubility. That is, it has a solubility of about 1 percent by weight in dilute acid solutions ($\approx$3%). We prefer to prepare the chitosan by reacting chitin with about a 40 percent aqueous sodium hydroxide solution for several hours at temperatures of about 130° to 150° C. We have found that chitosan is a useful dry strength additive in both alkaline and acid paper processes when used alone. In addition, we have also found that graft polymers of chitosan and certain acrylic and diallylic monomers yield excellent dry strength additives.

The useful monomers used in preparing the graft copolymers with chitosan are acrylamide, methacrylamide, acrylic acid, methacrylic acid and diallylic quaternary ammonium monomers as described for example in Butler U.S. Pat. No. 3,288,770. In addition, mixtures of one or more of these monomers are also useful in obtaining a polymer with the desired properties.

There are many well-known methods of grafting monomers onto carbohydrate substrates as is realized by one skilled in the art. The method ultimately chosen is not important so long as it yields a graft polymer onto a chitosan substrate. The method which we used is the ceric salt redox system. It is known that certain ceric salts form a redox system when coupled with certain reducing agents such as alcohols, aldehydes, or amines. The reaction proceeds by a single electron transfer step, resulting in cerous ion and a partially oxidized reducing agent in free radical form. The free radical being formed on the chitosan backbone. If a monomer is present, polymerization will occur. However, since the free radical is on the chitosan substrate, only graft polymers will be formed without contamination of other polymers. Using this method, we have prepared various graft copolymers with chitosan. However, the same copolymers may be prepared using any other of the well known grafting techniques. Examples 1 to 5 below illustrate the preparation of some of the graft copolymers of our invention.

EXAMPLE 1

Into a one liter, four-necked flask equipped with purge tube, thermometer, stirrer and condenser was added the following reagents. Twenty grams of chitosan, thirty grams of acrylamide and four hundred fifty grams of a 15 percent acetic acid solution. The compounds were then heated to 30° C. and stirred for one hour while being purged with nitrogen. The ceric catalyst was then added. The catalyst was a 0.1 normal ceric ammonium nitrate in one normal nitric acid solution. Five milliliters of the ceric solution was added and the reaction mixture stirred for three hours at 30° C. After three hours, the polymer was diluted to 1 to 5 percent solids with water and precipitated with acetone. The graft polymer was then dried under vacuum for twenty-four hours and tested for its dry strength properties.

EXAMPLE 2

Into a one liter, four-necked flask equipped with purge tube, thermometer, stirrer and condenser was added the following reagents. Five grams of chitosan, forty-five grams of acrylamide and four hundred fifty grams of a 15 percent acetic acid solution. The mixture was then heated to 30° C. and purged for one hour with nitrogen gas. Five milliliters of the ceric catalyst solution was then added. The catalyst solution was a 0.1 normal ceric ammonium nitrate in one normal nitric acid. The mixture was then stirred for three hours at 30° C. After three hours, the polymer was diluted with water and precipitated with acetone and dried under vacuum for twenty-four hours. It was then tested for dry strength properties.

EXAMPLE 3

Into a one liter, four-necked flask equipped with purge tube, thermometer, stirrer and condenser was added the following reagents. Five grams of chitosan, 40.5 grams of acrylamide, 4.5 grams of acrylic acid and four hundred fifty grams of a 15 percent acetic acid solution. The mixture was heated to 30° C. and purged for one hour with nitrogen gas. Five milliliters of the ceric catalyst solution was then added. The catalyst was a 0.1 normal ceric ammonium nitrate in one normal nitric acid. The mixture was then stirred for three hours at 30° C. After three hours, the polymer was diluted to about 1 to 5 percent solids with water and precipitated with acetone. It was then dried under vacuum and evaluated.

EXAMPLE 4

Into a one liter, four-necked flask equipped with purge tube, thermometer, stirrer and condenser was added the following reagents. Twenty grams of chitosan, twenty-seven grams of acrylamide, three grams of acrylic acid and four hundred fifty grams of a 15 percent acetic acid solution. The mixture was heated to 30° C. and purged for one hour with nitrogen gas. Five milliliters of the ceric catalyst solution was then added. The catalyst was a 0.1 normal ceric ammonium nitrate in one normal nitric acid. The mixture was then stirred for three hours at 30° C. After three hours, the polymer was diluted to about 1 to 5 percent solids with water and precipitated with acetone. It was then dried under vacuum and evaluated.

EXAMPLE 5

Into a one liter, four-necked flask equipped with purge tube, thermometer, stirrer and condenser was added the following reagents. Twenty grams of chitosan, 15 grams of acrylamide, 15 grams of dimethyl diallyl ammonium chloride and four hundred fifty grams of a 15 percent acetic acid solution. The mixture was purged with $N_2$ for one hour at 30° C. Five milliliters of the ceric catalyst solution was added. The catalyst was a 0.1 normal ceric ammonium nitrate in one normal nitric acid. The mixture was stirred for two hours at 30° C. An additional two and one half milliliters of catalyst solution was added. After four hours at 30° C., the graft polymer was diluted with water and precipitated with acetone.

We have prepared many additional graft copolymers using various other monomers. The monomers useful in our invention are acrylamide, methacrylamide, acrylic acid, methacrylic acid and the diallyl dialkyl quaternary ammonium monomers of the formula

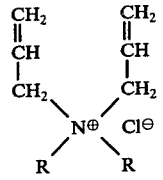

where "R" is selected from the group consisting of H and alkyl groups of one to four carbon atoms. The preferred compounds are where both "R" groups are either methyl (DMDAAC) or ethyl. In addition, we have prepared graft copolymers using a combination of two or more of the above monomers with chitosan.

The graft copolymers of our invention comprise from 5 to 99.5 percent by weight of the chitosan substrate and the remaining percentage being derived from one or more of the above mentioned monomers. As mentioned before, it is also within the scope of this invention to use the chitosan substrate alone as a dry strength additive. Therefore, in effect, our invention encompasses the use of from five to one hundred percent by weight chitosan. However, when dealing with the graft copolymers, it is generally necessary to have about 0.5 percent by weight of the monomer present in order to notice a change from the use of the pure chitosan. Therefore, the term chitosan, when used alone as a dry strength additive, is inclusive of graft copolymers containing up to about 0.5 percent by weight of monomer. The term graft copolymer of chitosan therefore covers those polymers containing greater than 0.5 percent by weight of the monomer.

The chitin-based compounds of our invention were evaluated for their dry strength in alkaline media and also several compounds were evaluated in acidic media. The compounds were also evaluated at various feed rates ranging from 0.25 percent to about 1 percent by weight based on the weight of the dry pulp.

The compounds were evaluated by preparing a series of hand sheets on a Noble Wood machine using the various additives. The hand sheets were then conditioned at 50 percent RH for a minimum of twenty-four hours at 70° F. and then tested for burst and tensile strength. The strength values were reported as a percent increase over the control. The control was a hand sheet prepared under similar conditions except no dry strength additives were employed.

The pulp stock used in preparing the hand sheets was bleached, hardwood sulfite pulp. The freeness was 650 cc Schopper Reigler. When using acid medium, 2 percent alum was also employed. However, when using alkaline medium, no additional additives other than the dry strength compound were used. The hand sheets prepared had a sheet weight of about three grams per sheet, which is approximately equivalent to forty-five pounds per 3,000 ft.$^2$ The dry strength compounds were added at the headbox and mixed there for three minutes. When running under acid conditions, the headbox and sheet mold pH was adjusted to 4.5 with 0.5 $NH_2SO_4$. When running under alkaline conditions, they were left unadjusted, which was a pH of from 7 to 9. During the preparation, there was no white water circulation. The sheets were dried for five minutes at 230° F. before conditioning and evaluating. The burst strength was tested by a Mullen Tester according to TAPPI standard test procedure T403. The tensile strength was tested by a TMI instrument in accordance with TAPPI standard test procedure T404.

The following tables illustrate the results of hand sheets prepared using some of the additives of our invention.

Table 1 illustrates the general effectiveness of chitosan alone as a dry strength additive and also the effectiveness of several of the graft copolymers of the chitosan with several of the preferred comonomers. In the tables, the compositions of the additives are given in weight percentages. For example, in Table 1, Sample No. 2, Chitosan/AM (10/90) means a graft copolymer of acrylamide onto chitosan and the weight percentages are 10 percent chitosan and 90 percent acrylamide. The percent feed rate was 1 percent by weight based on weight of the dry pulp. The symbol "AA" means acrylic acid and "DMDAAC" means dimethyl diallyl ammonium chloride.

Table 1

| Sample No. | Additive | Alkaline % Increase Burst | Alkaline % Increase Tensile | Acid % Increase Burst | Acid % Increase Tensile |
|---|---|---|---|---|---|
| 1 | Chitosan | 32.9 | 20.0 | 12.1 | 18.5 |
| 2 | Chitosan/AM (10/90) | 28.7 | 16.3 | | |
| 3 | Chitosan/AM (40/60) | Flocked | Flocked | 31.1 | 14.1 |
| 4 | Chitosan/AM/AA (10/81/9) | Flocked | Flocked | 32.7 | 19.0 |
| 5 | Chitosan/AM/AA (40/54/6) | 34.9 | 17.0 | 45.0 | 36.9 |
| 6 | Chitosan/AM/DMDAAC (40/30/30) | 43.3 | 31.2 | | |

Table 2 illustrates the effect of various feed rates on several of the dry strength additives shown in Table 1.

Table 2

| Sample No. | Additive | Percent Feed Rate | Alkaline pH % Increase Burst | Alkaline pH % Increase Tensile | Acid pH % Increase Burst | Acid pH % Increase Tensile |
|---|---|---|---|---|---|---|
| 1 | Chitosan | 1.0 | 32.9 | 20 | 12 | 19 |
| 2 | Chitosan/Acrylamide (10/90) | 1.0 | 28.7 | 16.3 | — | — |
| 3 | Chitosan/Acrylamide (40/60) | 1.0 | 56.8 | 39.2 | 46.2 | 25.8 |
| | | 0.5 | 44 | 27.2 | 37.4 | 22.9 |
| | | 0.25 | 21 | 16.4 | 28.1 | 19.4 |
| 4 | Chitosan/Acrylamide/ Acrylic Acid (10/81/9) | 1.0 | Flocked | Flocked | 60.9 | 31.5 |
| | | 0.5 | 21.4 | 19.3 | 48.8 | 21.9 |
| | | 0.25 | 29.4 | 19.9 | 24.6 | 14.5 |
| 5 | Chitosan/Acrylamide/ Acrylic Acid (40/54/6) | 1.0 | 34.9 | 17 | 45 | 36.9 |

Table 3 illustrates the effect on composition for a series of chitosan/acrylamide compounds. The feed rate for this series was 1 percent. The series was run in alkaline medium only. The results in the table illustrate that the graft copolymers are generally more effective than the chitosan alone or the polyacrylamide alone.

Table 3

| Sample No. | Additive Percent Chitosan | Additive Percent Acrylamide | Alkaline Percent Increase Burst | Alkaline Percent Increase Tensile |
|---|---|---|---|---|
| 1 | 100 | 0 | 15.99 | 8.69 |
| 2 | 80 | 20 | 41.49 | 33.50 |
| 3 | 60 | 40 | 55.56 | 28.83 |
| 4 | 40 | 60 | 50.78 | 26.22 |

Table 3-continued

| Sample No. | Additive Percent Chitosan | Additive Percent Acrylamide | Alkaline Percent Increase Burst | Alkaline Percent Increase Tensile |
|---|---|---|---|---|
| 5 | 20 | 80 | 28.09 | 21.33 |
| 6 | 10 | 90 | 24.03 | 13.54 |
| 7 | 0 | 100 | 10.32 | 2.28 |

Table 4 illustrates the effect of composition for another series of chitosan/acrylamide compounds. This series was tested both in acid and alkaline media. The feed rate was 1 percent.

Table 4

| Sample No. | Additive Percent Chitosan | Additive Percent Acrylamide | Alkaline % Increase Burst | Alkaline % Increase Tensile | Acid % Increase Burst | Acid % Increase Tensile |
|---|---|---|---|---|---|---|
| 1 | 80 | 20 | 48.3 | 20.2 | 40.4 | 18.7 |
| 2 | 70 | 30 | 50.9 | 30.1 | 33.4 | 16.2 |
| 3 | 60 | 40 | 46.5 | 28.3 | 40.1 | 20.2 |
| 4 | 50 | 50 | 45.4 | 34.6 | 39.6 | 17.5 |
| 5 | 40 | 60 | 46.8 | 29.6 | 48.2 | 24.8 |
| 6 | | 100 | 1.0 | 0.4 | | |

Table 5 illustrates the effect of a series of graft copolymers of acrylamide and acrylic acid onto chitosan. The feed rate was 1 percent.

Table 5

| Sample No. | Additive Percent Chitosan | Additive Percent Acrylamide | Additive Percent Acrylic Acid | Acid % Increase Burst | Acid % Increase Tensile |
|---|---|---|---|---|---|
| 1 | 10 | 81 | 9 | 33.2 | 12.6 |
| 2 | 40 | 54 | 6 | 50.3 | 39.6 |
| 3 | 60 | 40 | 0 | 26.3 | 26.6 |
| 4 | 60 | 38 | 2 | 27.7 | 16.4 |
| 5 | 60 | 36 | 4 | 32.3 | 26.9 |
| 6 | 60 | 32 | 8 | 22.8 | 14.0 |

Table 6 illustrates the effect of varying the feed rate on several of the copolymers from Table 5.

Table 6

| Sample No. | Additive | Percent Feed Rate | Acid % Increase Burst | Acid % Increase Tensile |
|---|---|---|---|---|
| 1 | Chitosan/AM/AA (10/81/9) | 1 | 52.08 | 36.58 |
| | | 0.5 | 29.16 | 14.63 |
| | | 0.25 | 14.81 | 6.34 |
| 2 | Chitosan/AM/AA (40/54/6) | 1 | 70.20 | 45.49 |
| | | 0.5 | 49.05 | 35.07 |
| | | 0.25 | 33.86 | 20.85 |

As can be seen from the above tables, the compounds of our invention are effective dry strength additives in both acid and alkaline media and at various feed rates.

The paper of the present invention, generally, is prepared by forming an aqueous suspension of papermaking cellulosic fibers, adding to said suspension a dry strength additive and any other desirable additive, sheeting the fibers to form a cellulosic web and heating the web until dry to form the paper.

The dry strength additives of the present invention may be added to the cellulosic pulp suspension in amounts ranging from 0.1 to 5.0 percent by weight based on the dry weight of the cellulosic fibers. Below 0.1 percent, no appreciable effect on the paper is noticeable and the use of concentrations in the neighborhood of 5 percent is generally an overtreatment. The preferred range is from 0.2 to 1.0 percent.

The exact pH and concentration at which the dry strength additives of our invention will be utilized in the papermaking process will vary from instance to instance. It will depend largely on the type of cellulosic fiber being employed, the other common papermaking additives being used, and the properties desired of the final product. Accordingly, in each instance, the optimum conditions can easily be found by simple laboratory trials. However, the dry strength additives of our invention are effective within the pH range of about 3.5 to 9.0 and in the concentration range mentioned above.

The polymers of our invention may be added at any convenient point in the papermaking process so long as they are added up stream from the fan pump. In addition, they may be added as a dry powder or an aqueous solution. The use of an aqueous solution is preferred since it insures a more uniform mixture of the additive and paper fibers.

The temperature at which the sheet is dried and the duration of the drying are not critical. The additives are substantially non-thermosetting and hence need not be subjected to any critical, drying conditions. Therefore, the invention contemplates that the paper will be produced by drying on rolls in the normal range of 190° to 250° F.

The dry strength additives of our invention are also compatible with most of the other commonly employed materials used in the paper formation. For example, they are compatible with rosin and the other common sizing agents, alum, the pigments such as clay, $CaCO_3$ and $TiO_2$, and the basically used dyes.

We claim:

1. An improved process for making paper having dry strength comprising forming an aqueous suspension of papermaking cellulosic fibers, adding to said suspension a dry strength additive, sheeting the fibers to form a web and heating the web until dry to form the paper, wherein the improvement comprises using as the dry strength additive, a graft copolymer comprising from 5 to 99.5 percent by weight of a chitosan substrate and the remainder derived from acrylamide monomer.

* * * * *